US005837416A

United States Patent [19]

Tavernier et al.

[11] Patent Number: 5,837,416

[45] Date of Patent: Nov. 17, 1998

[54] TONER PARTICLES COMPRISING SPECIFIED POLYMERIC BEADS IN THE BULK OF THE TONER PARTICLES

[75] Inventors: Serge Tavernier, Lint; Ronny De Clercq, Aalter; Ludo Joly, Hove; Werner Op de Beeck, Keerbergen, all of Belgium

[73] Assignee: Agfa-Gevaert, N.V., Mortsel, Belgium

[21] Appl. No.: 870,422

[22] Filed: Jun. 5, 1997

Related U.S. Application Data

[60] Provisional application No. 60/024,809, Aug. 29, 1996.

[30] Foreign Application Priority Data

Jun. 6, 1996 [EP] European Pat. Off. ..... 96201584

[51] Int. Cl.[6] ..... G03G 9/097; G03G 13/20

[52] U.S. Cl. ..... 430/110; 430/111; 430/124

[58] Field of Search ..... 430/110, 111

[56] References Cited

U.S. PATENT DOCUMENTS

| | | | |
|---|---|---|---|
| 4,659,641 | 4/1987 | Mahalek et al. | 430/137 |
| 4,950,573 | 8/1990 | Yamaguchi et al. | 430/109 |
| 5,202,215 | 4/1993 | Kanakura et al. | 430/110 |
| 5,310,616 | 5/1994 | Akamatsu | 430/110 |

FOREIGN PATENT DOCUMENTS

| | | |
|---|---|---|
| 0 486 235 A2 | 5/1992 | European Pat. Off. . |
| 0 664 492 A2 | 7/1995 | European Pat. Off. . |
| 0 698 625 A1 | 2/1996 | European Pat. Off. . |

OTHER PUBLICATIONS

Patent Abstracts of Japan, vol. 12, No. 214, Jun. 18, 1988 & JP–A–63 011949 (Seiko Epson), Jan. 19, 1988.

Derwent Publication re JP–A–04 142 556, 15 May 1992.

*Primary Examiner*—Roland Martin
*Attorney, Agent, or Firm*—Breiner & Breiner

[57] ABSTRACT

Toner particles are provided, having an average volume diameter $d_{vt}$ and comprising a binder resin with melting point $TSM_t$, and comprising polymeric beads incorporated in the bulk of the toner particles, characterized in that the polymeric beads have i) a melting point $TSM_p$ in °C., such that $TSM_p \geqq TSM_t + 10°$ C. and ii) an average volume diameter $d_{vp}$ such that $0.20 \leqq d_{vp}/d_{vt} \leqq 0.75$.

15 Claims, No Drawings

TONER PARTICLES COMPRISING SPECIFIED POLYMERIC BEADS IN THE BULK OF THE TONER PARTICLES

This application claims the benefit of U.S. provisional application Ser. No. 60/024,809, filed Aug. 29, 1996.

FIELD OF THE INVENTION

The present invention relates to toner particles, that can be used for gloss control in toner images. It also relates to a toner composition suited for development of electrostatic charge images or magnetic patterns and for Direct Electrostatic Printing.

BACKGROUND OF THE INVENTION

Electrostatic printing methods are manifold, e.g. Direct Electrostatic Printing, wherein electrostatic printing is performed directly from a toner delivery means on a receiving substrate, the latter not bearing any imagewise latent electrostatic image, by means of an electronically addressable printhead structure.

In another form of electrostatic printing toner images are made on an image-forming element in the form of a rotating drum provided with an electrostatic layer built up from a number of controllable electrodes in and beneath a dielectric layer. The voltage that is image-wise applied to said controllable electrodes attracts charged toner particles from a toner source.

It is also well known in the art of electrographic printing and electrophotographic copying to form an electrostatic latent image corresponding to either the original to be copied, or corresponding to digitized data describing an electronically available image.

In electrophotography an electrostatic latent image is formed by the steps of uniformly charging a photoconductive member and imagewise discharging it by an imagewise modulated photo-exposure.

In electrography an electrostatic latent image is formed by imagewise depositing electrically charged particles, e.g. from electron beam or ionized gas onto a dielectric substrate.

The obtained latent images are developed, i.e. converted into visible images by selectively depositing thereon light absorbing particles, called toner particles, which usually are triboelectrically charged.

In magnetography a latent magnetic image is formed in a magnetizable substrate by a pattern-wise modulated magnetic field. The magnetizable substrate must accept and hold the magnetic field pattern required for toner development which proceeds with magnetically attractable toner particles.

In toner development of latent electrostatic images two techniques have been applied: "dry" powder and "liquid" dispersion development of which dry powder development is nowadays most frequently used.

In dry development the application of dry toner powder to the substrate carrying the latent electrostatic image may be carried out by different methods known as, "cascade", "magnetic brush", "powder cloud", "impression" or "transfer" development also known as "touchdown" development described e.g. by Thomas L. Thourson in IEEE Transactions on Electronic Devices, Vol. ED-19, No. 4, April 1972, pp.495–511.

The visible image of electrostatically or magnetically attracted toner particles is not permanent and has to be fixed by causing the toner particles to adhere to each other and the substrate by softening or fusing them followed by cooling.

Normally fixing proceeds on more or less porous paper by causing or forcing the softened or fused toner mass to penetrate into the surface irregularities of the paper.

Dry-development toners essentially comprise a thermoplastic binder consisting of a thermoplastic resin or mixture of resins (ref. e.g. U.S. Pat. No. 4,271,249) including colouring matter, e.g. carbon black or finely dispersed dye pigments or soluble dyes. The triboelectrically chargeability is defined by said substances and may be modified with a charge controlling agent.

Electrostatographic processes can not only be employed to form monochrome (black) images, but also to form colour images. It is known to form full colour images by sequentially forming and developing electrostatic colour separation images with cyan, magenta, yellow and black toners respectively. In such applications high quality toners are needed and gloss control in the finished image is highly desired. In contact fusing processes, where the fusing proceeds by pressure and heat, the gloss can be controlled by adjusting the surface of the pressure providing means (usually a roller), the amount of heat, the amount of pressure, etc. A contact fusing process presents however some drawbacks, the most important being the risk of hot-offset, i.e. toner particles adhering to the pressure roller. To overcome this drawback in some cases silicon oil is provided on the surface of the fuser roller or the toner particles are especially designed regarding the composition of the toner particle, or a combination of both is made. Especially in the case of colour images, the problem of hot offset poses itself more severely, as a good colour image imposes intermixing of toner particles of different colour in order to realise well mixed colours. This means that the toner is molten to a high degree and hence that hot offset is very likely. In order to prevent the offset, no good solutions are offered up to now. The use of silicone oil makes the fuser more complex as the amount has to be metered exactly in order to reduce stripes deteriorating the image quality. Second problem is the fact that oil makes the image somewhat shiny reducing the quality aspect, since observers prefer an even, slightly satin looking image, and no oily surface. The option to reduce hot offset by proper design of the toner imposes also problems. It is done by designing a toner with either a release agent, offering limited lifetime of the developer and photoconductor due to the smearing of the waxy release agent or it imposes the use of cross-linked resins in the toner particle, reducing good interpenetration of the toner and hence good colour mixing. So in the case contact fusing is used, up until now, no proper solution for gloss engineered images is found.

Therefore methods for producing toner images using non-contact fusing steps may be preferred. However these also pose problems as the toner resins are to be designed low viscous in behaviour above the softening point of the toner. This implies that the toners have the tendency to interflow very good and to offer rather smooth surfaces, thus giving a rather high gloss. The single layers are conforming to the paper and offer a less smooth image. The bi-, ter- and quadruple layers are however more glossy. Therefore there is apart from a rather glossy appearance the problem of gloss differences depending on thickness.

Means for controlling the gloss of a non-contact fixed toner image have been disclosed in EP-A 656 129, wherein it is disclosed to add to the toner particles compounds that are slightly incompatible with the toner resin or by blending two slightly incompatible polymers and to use that blend as toner resin. In European Application 96200977.5 filed on Apr. 9, 1996 it is shown to control the gloss in a toner image by adding a number of different inorganic hydrophobic particles to a toner composition, and by adjusting the BET surface of the different hydrophobic inorganic particles to the BET surface of the toner particles.

As an other solution to improve the gloss of a toner image, it has been disclosed to apply a layer of colourless toner particles on top of the four colour toner image. Typical examples of such layers and different ways to apply such a layer are disclosed in, e.g., EP-A 629 921, EP-A 486 235, U.S. Pat. No. 5,234,783, U.S. Pat. No. 4,828,950, EP-A 554 981, WO 93/07541 and Xerox Research Disclosure Journal, Vol.16, N° 1, p. 69 (January/February 1991).

In WO 90/11552 it is disclosed to impart a different finish to the final print by passing the print under different finishing rollers having different surface structures. This method gives good results, but requires the insertion in the electro(photo) graphic apparatus for photo-finishing of different finishing rollers with exactly machined surface.

The problem of gloss control is present in any toner image wherein the image is made by superposition of various layers of toner particles. This is especially so in full colour images were different colours and hues are realized by the superposition of yellow, magenta, cyan and black (YMCK) toners. Also in black and white toner images gloss control can be very desired. This is so in black and white images, as disclosed in EP-A 768 577, wherein the grey scale (tonal range) in a black and white electrostatographic image, fixed to a final substrate, is extended by realizing the necessary different shades of grey with the superposition of toner particles comprising different amounts of black pigment.

The means for gloss-control that have hitherto been disclosed make indeed gloss control possible, but it is still desired to have further means to control the gloss of a toner image.

OBJECT AND SUMMARY OF THE INVENTION

It is an object of the invention to provide toner particles that can be used to print toner images that have semi-matte or matte surface finish on the surface.

It is an other object of the invention to provide toner particles that make it possible to control the gloss of toner images realized by the superposition of a plurality of toner layers.

It is an other object of the invention to provide clear toner materials making it possible to cover the surface of the print with the desired surface finish.

It is a further object of the present invention to provide toner particles that can be used to make colour prints from either negatives or transparencies, that have semi-matte or matte surface finish on the surface of the colour print.

It is still a further object of the invention to provide an electro(stato)graphic imaging method, wherein the toner image can be overlaid with a finish of choice.

Further objects and advantages of the invention will become clear from the description hereinafter.

The objects of the invention are realised by providing toner particles, having an average volume diameter $d_{vt}$, comprising a binder resin with melting point $TSM_t$, and comprising polymeric beads incorporated in the bulk of said toner particles, characterised in that said polymeric beads have i) a melting point $TSM_p$ in °C., such that $TSM_p \geqq TSM_t + 10°$ C. and ii) an average volume diameter $d_{vp}$ such that $0.20 \leqq d_{vp}/d_{vt} \leqq 0.75$.

DETAILED DESCRIPTION OF THE INVENTION

It has been found that the gloss and surface finish of toner images, especially of those images that are made by the superposition of a plurality of toner layers, could easily be controlled by using toner particles, comprising a toner resin, wherein in the bulk of the particles polymeric beads were present.

Toner particles, comprising 0.5% by weight of a cross-linked siloxane compound, being present as granules (particles) having an average particle diameter from 0.3 to 70μm, have been disclosed in JP-A 04/142556. The toners, exemplified in this disclosure, will comprise particles incorporating the siloxane compound together with free siloxane granules. This can give rise to problems in chargeability of the toner, since the toner particles and the free siloxane granules will, through tribo-contact with carrier particles, get a different charge.

In DE-A 37 39 217 toner particles comprising polymeric beads are disclosed. This polymeric beads have a diameter of at most 25% of the diameter of the toner particles and are only imbedded in the surface of the toner particles and are not incorporated in the bulk of the toner particles. This tone is said to combine good fixing at low temperature with low hot-offset properties.

It was found that the toner particles of the prior art disclosures, cited immediately above, did not provide the desired gloss control. It was found that the polymeric beads, had to be incorporated in the bulk of the toner Particles and had to have a high melting point, above the melting point of the toner resin that is used to prepare the toner particles. The melting point of said polymeric beads is at least 10° C. higher than the melting point of the toner resin, and preferably the melting point of the polymeric beads is 25° C. higher than the melting point of the toner resin.

The melting point of the toner particles $TSM_t$ and the melting point of the polymeric beads $TSM_p$ were measured in a SHIMADZU FLOWTESTER CFT-500, trade name of Shimadzu Corporation, Tokyo, Japan. 1.5 g of the material to be measured were pressed in a tablet form and introduced in the measuring cell of said FLOWTESTER CFT-500. On the tablet a pressure of 1.96 $10^6$ Pa was exerted to extrude the polymers through a nozzle. The nozzle through which the molten polymer was extruded had a diameter of 1 mm and a length of 1 mm. The measuring cell was heated from 40° C. on with a constant linear rate of 3° C./min. The temperature of the measuring cell at the time when 50% by weight of the sample has been extruded was noted as melting point.

It was found that gloss and finish control in a toner image could be achieved when the average volume diameter of the polymeric beads $d_{vp}$ was at least 20% and at most 75% of the volume average diameter $d_{vt}$ of the toner particles. Preferably the ratio $d_{vp}/d_{vt}$ is between 0.3 and 0.6. When $d_{vp}/d_{vt}<0.20$ the effect on gloss equalization in minimal, when $d_{vp}/d_{vt}>0.75$ the amount of polymeric beads that can be incorporated is too low.

It is preferred, in toner particles according to the present invention to in corporate between 5 and 50% by weight with respect to the weight of the other toner ingredients (e.g. toner resin, pigment, charge control agent, etc) of polymeric beads. In a more preferred embodiment between 10 and 30% by weight of polymeric beads are incorporated in the bulk of the toner particles. When polymeric beads are present in the bulk of the toner particles in amounts as described above, it is possible to change the gloss of the fused toner particles from high glossy to matte by adjusting the amount and the diameter of the polymeric beads within the boundaries of this invention.

The polymeric beads preferably comprise polymers derived from α,β-ethylenically unsaturated monomer(s) that have been cross-linked. Very suitable α,β-ethylenically unsaturated monomers, for the preparation of the polymer beads, useful to be incorporated in toner particles according to the present invention are, e.g., styrene, vinyltoluene and substituted vinyltoluene e.g. vinyl benzyl chloride and the homologues thereof, chlorostyrene, alkyl methacrylates e.g. methyl methacrylate, ethyl methacrylate, propyl methacrylate, butyl methacrylate and the higher methacrylates, e.g. stearyl methacrylate; substituted alkyl methacrylates e.g. hydroxyethyl methacrylate; butadiene, isobutylene, chlorobutadiene, 2-methylbutadiene; vinyl pyridines e.g. 2- and 4-vinylpyridine, etc. A combination of these monomers as well as one of them alone may be chosen depending on the particular needs. In a preferred embodiment, said α,β-ethylenically unsaturated monomer, is a mixture of at least two monomers selected from the group of methylacrylate, methylmethacrylate, stearylacrylate and stearylmethacrylate. Most preferred said mixture of two monomers comprises a methylester of either acrylic acid or methacrylic acid together with a stearylester of either acrylic acid or methacrylic acid.

The cross-linking may proceed by combining at least one monomer carrying at least one carboxyl group in free acid form and at least one monomer carrying at least one halogen atom with said α,β-ethylenically unsaturated monomer(s). During the polymerization of the mixture of monomers the free acid group and the halogen atom react together and form cross-links. Such cross-linked polymeric beads have been disclosed in EP-A 466 982 and the equivalent U.S. Pat. No. 5,252,445.

It is preferred to use polymeric beads wherein the cross-linking is performed by combining at least one silane monomer with said α,β-ethylenically unsaturated monomer (s). The silane monomer preferably corresponds to following formula I:

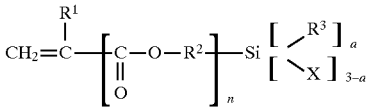

wherein $R^1$=H or $CH_3$ $R^2$=a linear or branched $C_2$–$C_{12}$-alkylene group, the chain of which may be interrupted by at least one member selected from the group consisting of —O—, —NH—, —COO— or —NH—COO— groups $R^3$=a linear or branched $C_1$–$C_6$ alkyl group or a phenyl group X=a hydrolysable group a=0, 1 or 2 and n=0 or 1.

In the most preferred embodiment $R^1$ is a methyl group.

$R^2$ can be, e.g., dimethylene, trimethylene, tetramethylene, pentamethylene, hexamethylene, octamethylene, decamethylene or dodecamethylene. When $R^2$ is branched, it can be e.g. 1,2 propylene, 1,2 and 1,3 butylene etc. When in $R^2$ —O—, —NH—, —COO— or —NH—COO— groups are present, $R^2$ is a polyether, polyamine, an oligoester or a oligourethane. In a preferred embodiment $R^2$ is a $C_2$–$C_8$ alkylene that can be interrupted by one or more —O— groups.

In a further preferred embodiment $R^2$ is a $C_2$–$C_4$ group, e.g. ethylene, n-propylene, n-butylene, i-propylene, i-butylene or t-butylene. In the most preferred embodiment $R^2$ is n-propylene.

$R^3$ can be, e.g., methyl, ethyl, n-propyl, i-propyl, n-butyl, i-butyl or t-butyl, or the known $C_5$ or $C_6$ alkyl groups.

X can be any hydrolysable group known in the art, e.g., a halogen (F, Cl, Br), an alkoxygroup, a carboxylategroup or a carbonamid group. When X is a halogen it is preferred that X=Cl. When X is a carboxylate group, it is preferred to use either acetate or propionate groups and when X is a carbonamid group it is preferred to use acetylamino or propionylamino groups. When X is an alkoxygroup, any $C_1$ to $C_6$ alkoxy group can be used. It is preferred, however to use a methoxy or ethoxy group. In a further preferred embodiment X is either Cl or —$OCH_3$ or —$OCH_2$—$CH_3$. In a most preferred embodiment X=—$OCH_3$. In the most preferred embodiment a=0 and n=1. In the most preferred embodiment the silane monomer used is:

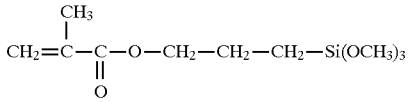

Useful polymeric beads, hardened by a silane monomer are disclosed in e.g. EP-A 417 539.

The polymeric beads, useful to be incorporated in toner particles according to the present invention, are preferably prepared by a method described in EP-A 698 625, which is incorporated herein by reference. This method comprises the steps of:

A) dissolving in an aqueous reaction medium:

1) a silane monomer corresponding to following formula:

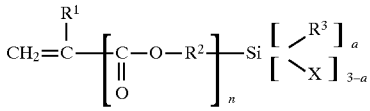

wherein $R^1$=H or $CH_3$ $R^2$=a linear or branched $C_2$–$C_{12}$-alkylene group, the chain of which may be interrupted by at least one member selected from the group consisting of —O—, —NH—, —COO— or —NH—COO— groups $R^3$=a linear or branched $C_1$–$C_6$ alkyl group or a phenyl group X=a hydrolysable group a=0, 1 or 2 n=0 or 1

2) at least one α,β-ethylenically unsaturated monomer, different from said silane monomer(s), capable of forming a polymer that is soluble in the α,β-ethylenically unsaturated monomer(s) present in said aqueous reaction medium but which is insoluble in water 3) a free radical-forming polymerization initiator that is soluble in the aqueous reaction medium, and 4) a graft-polymerizable polymer containing hydrophillic groups, and capable of forming a graft polymer that remains soluble in said aqueous reaction medium, wherein the amount of said silane monomer present in said aqueous reaction medium is higher than 1% and lower than 25% in weight with respect to the total monomer content and the weight ratio of said graft-polymerizable polymer to said monomer(s) is in the range from 0.2:100 to 8:100 and the weight ratio of polymerization initiator to monomer(s) from 0.1:100 to 6:100, and B) heating the solution to a temperature from 50° C. to the reflux temperature thereof with continuous stirring.

In the aqueous reaction medium a silane monomer according to the general formula I, is present in an amount higher than 1 and lower than 25% in weight (% w/w) with respect to the total of the monomers present in the aqueous reaction medium. In a preferred embodiment said silane monomer is present in the aqueous reaction medium for between 2 and 15% in weight (% w/w) with respect to the total monomer content, in the most preferred embodiment said silane monomer is present in the aqueous reaction medium for between 2 and 10% in weight (% w/w) with respect to the total monomer content. By total monomer content is meant the sum of amount the silane monomer(s) present in the reaction medium and of the amount of α,β-ethylenically unsaturated monomers, different from said silane monomers.

The polymer beads comprising a silane hardened polymer are produced by the simultaneous polymerization reaction of the α,β-ethylenically unsaturated monomers and cross-linking reaction, induced by the silane monomers that are hydrolysed by the water comprised in the aqueous reaction medium. These beads are stabilized by the incorporation of a graft polymer. This graft polymer is formed and incorporated in the polymeric beads simultaneously with the polymerization reaction of the α,β-ethylenically unsaturated monomers and the hardening reaction of the polymeric beads by the silane monomer. In order to incorporate a graft polymer in the polymeric beads according to the present invention a graft-polymerizable polymer is formed. A graft-polymerizable polymer used in the aqueous reaction medium according to the present invention, is a homopolymer or copolymer, which in the presence of radicals and can be converted into a living molecule, on which by graft-copolymerization side-chains can be implanted. In a preferred embodiment said graft-polymerizable polymer is either polyvinylpyrolidone or co((styrene/maleic acid monosodium salt) and said silane monomer is present in the aqueous reaction medium for between 2 and 15% in weight (% w/w) with respect to the total monomer content.

The toner particles according to the present invention, incorporating polymeric beads in the bulk of them, can comprise any toner resin known in the art. The toner resin can be a polycondensation polymer or a mixture of polycondensation polymers as well as an addition polymer or a mixture of addition polymers. Also mixtures of polycondensation polymers and addition polymers are suitable as toner resin for toner particles according to the present invention. When polycondensation polymers are used, the use of polyesters is preferred.

Polyester resins suitable for use in toner particles according to the present invention are selected e.g. from the group of linear polycondensation products of (i) di-functional organic acids, e.g. maleic acid, fumaric acid, terephthalic acid and isophthalic acid and (ii) di-functional alcohols (diol) such as ethylene glycol, triethylene glycol, an aromatic dihydroxy compound, preferably a bisphenol such as 2,2-bis(4-hydroxyphenyl)-propane called "Bisphenol A" or an alkoxylated bisphenol, e.g. propoxylated bisphenol examples of which are given in U.S. Pat. No. 4,331,755. For the preparation of suitable polyester resins reference is made to GB-P 1,373,220.

When addition polymers are used, it is preferred to use styrene/acrylic resins. Preferred styrene-acrylic resins have a relatively high (more than 70 mol %) styrene content, and are more particularly copolymers of styrene-acrylic resins or styrene-methacrylic resins, e.g. copoly(styrene/n-butylmethacrylate) or copoly(styrene/2-ethyl-hexylacrylate).

It is possible to further control the gloss of toner particles comprising polymeric beads according to this invention, by using a mixture of polymers as toner resin, the polymers forming the mixture being selected in such a way that they have slight incompatibility with respect to each other. The HILDEBRAND parameter solubility for polymers is described in the book "Properties of Polymers" by D. W. Van Krevelen, 2nd. ed., Elseviers Scientific Publishing Company, New York, 1976, Chapter 7.

In general the desired slight incompatibility can be obtained by combining, as described in EP-A 656 129, that is incorporated herein by reference, a thermoplastic resin, e.g. a polyester, with a resin having a more polar character than said thermoplastic resin. By more polar character is meant possessing a higher dielectric constant and/or better wettability by water. In a preferred embodiment, said toner particles of the invention, said mixture of polymers A and B is a mixture of two polyesters having a different polar character: a polyester resin with low (less than 5.5 mol/kg) carbonyloxy group (—CO.O—) content (the carbonyloxy groups are part of the ester groups), being preferably derived from a non-aromatic dicarboxylic acid, e.g. fumaric acid and an ethoxylated and/or propoxylated Bisphenol A, and a second polyester resin being a polyester with high (at least 7.5 mol/kg) carbonyloxy group content, being preferably a polyester derived from an aromatic dicarboxylic acid and a diol. The latter polyester is preferably derived from terephthalic acid and isophthalic acid, or mixtures thereof. In the production of said second polyester the diol is preferably ethylene glycol optionally mixed with DIANOL 22 and DIANOL 33 as long as the ethylene glycol content of the totality of diols is more than 50 mol %, preferably at least 60 mol %.

A linear polyester of fumaric acid and DIANOL 33 is marketed under the tradename ATLAC T500 (Tg=50.5° C.) (ATLAC is a registered trade name of Atlas Chemical Industries Inc. Wilmington, Del. U.S.A.).

DIANOL 22 is di-ethoxylated Bisphenol A.

DIANOL 33 is di-propoxylated Bisphenol A.

Bisphenol A=4,4'isopropylidenediphenol.

The toner resin in toner particles according to this invention can also be a mixture of a polymer A and B, wherein polymer A is a polyester and polymer B a styrene-acrylic resin. This latter resin has preferably a relatively high (more than 70 mol %) styrene content, more particularly copolymers of styrene-acrylic resins or styrene-methacrylic resins, e.g. copoly(styrene/n-butylmethacrylate) or copoly(styrene/2-ethyl-hexylacrylate). Styrene-acrylic polymers, useful in toner particles according to the present invention, have preferably a weight-average molecular weight between 7,000 and 50,000 and a melt viscosity lower than 10,000 poise (1000 Pas). The meltviscosities mentioned herein are measured in a RHEOMETRICS dynamic rheometer, RVEM-200 (One Possumtown Road, Piscataway, N.J. 08854 USA) is used. The viscosity measurement is carried out at a sample temperature of 120° C. The sample having a weight of 0.75 g is applied in the measuring gap (about 1.5 mm) between two parallel plates of 20 mm diameter one of which is oscillating about its vertical axis at 100 rad/sec and amplitude of $10^{-3}$ radians.

Typical useful resins for the toner resin, used alone or in a mixture, in toner particles according to the present invention are tabulated in table 1.

TABLE 1

| Polymer | Tg °C. | Melt† Pa.s | $M_w$ | $M_n$ | TSM °C. | CC* mol/kg |
|---|---|---|---|---|---|---|
| Polyester P1 | 50,5 | 180 | 14,000 | 4,500 | 100 | 4.88 |
| Polyester P2 | 65 | 550 | 11,500 | 3,700 | 110 | 7.19 |
| Polyester P3 | 63 | 700 | 16,000 | 3,500 | 108 | 8.33 |
| Polyester P4 | 69 | 1600 | 25,500 | 7,100 | 112 | 13.89 |
| Styr/acryl S1 | 67 | 1700 | 33,000 | 13,000 | 118 | — |
| Styr/acryl S2 | 68 | 285 | 6,500 | 2,000 | 102 | — |
| Styr/acryl S3 | 78 | 170 | 19,000 | 7,000 | 110 | — |
| Styr/acryl S4 | 79 | 290 | 24,000 | 9,000 | 116 | — |
| Styr/acryl S5 | 79.5 | 698 | 36,000 | 13,500 | 120 | — |
| Styr/acryl S6 | 79 | 2252 | 60,500 | 23,000 | 125 | — |

†meltviscosity in Pa.s
*carboxyloxy content

Polyester P1 is ATLAC T500 (tradename).

Polyester P2 is an aromatic polyester resin derived from terephthalic acid (100 mol %) as aromatic diacid and a mixture of DIANOL 33 (50 mol %) and ethylene glycol (50 mol %) as diols.

Polyester P3 is an aromatic polyester resin derived from terephthalic acid (40 mol %), isophthalic acid (60 mol %) as aromatic di-acids and a mixture of DIANOL 22 (40 mol %) and ethylene glycol (60 mol %).

Polyester P4 is an aromatic polyester resin derived from terephthalic acid (64 mol %), isophthalic acid (36 mol %) as aromatic di-acids and ethylene glycol (100 mol %).

Styr/acryl S1 is a copolymer of styrene and methyl acrylate in a 65/35 molar ratio.

Styr/acryl S2 is a terpolymer of styrene, methyl acrylate and dimethylaminoethyl methacrylate in a 87/3/10 molar ratio.

Styr/acryl S3, S4, S5 and S6 are a copolymer of styrene and methyl acrylate in a 80/20 molar ratio, only differing in molecular weight.

Toner particles according to the present invention can also comprise other mixtures of toner resins. Very suitable mixtures of resins to be used as toner resin in this invention are described in U.S. Pat. No. 5,395,726, which is incorporated herein by reference. U.S. Pat. No. 5,395,726 discloses a mixture of resins, resin A and at least one resin B, characterized in that:

(1) said resin(s) A and said resin(s) B each have a glass transition temperature (Tg) larger than 45° C., (2) the Tg of said resin(s) A is at least 2.5° C. lower than the Tg of said resin(s) B, (3) the melt viscosity (mvA) of said resin(s) A is at least 50 Pas and the melt viscosity (mvB) of said resin(s) B is within the scope of the following equation:

$$(mvB)=F\times(mvA),$$

wherein F is an integer from 2 to 20, and with a maximum value of (mvB) not exceeding 1500 Pas, and (4) the weight ratio of said resin(s) A and said resin(s) B in said powder particles is such that the deformability of the powder material is lower than 15%, measured according to the method disclosed in U.S. Pat. No. 5,395,726.

Toner particles according to the present invention, can also incorporate modified resins, e.g. amorphous polymers modified by including side chains of crystalline polymers, as disclosed in EP-A 712 881 or polymers comprising polysiloxane moieties (PS), as disclosed in EP-A 740 217.

Toner particles, according to the present invention, can have an average volume diameter between 1 and 50 μm, preferably between 3 and 20 μm, most preferably between 5 and 10 μm. The particle size distribution of said toner particles can be of any type. It is however preferred to have an essentially (some negative or positive skewness can be tolerated, although a positive skewness, giving less smaller particles than an unskewed distribution, is preferred) Gaussian or normal particle size distribution, either by number or volume, with a coefficient of variability (standard deviation divided by the average) (v) smaller than 0.5, more preferably of 0.3.

Toner particles, used in toner compositions according to the present invention, can comprise any normal toner ingredient e.g. charge control agents, pigments both coloured and black, anorganic fillers, etc. A description a charge control agents, pigments and other additives useful in toner particles, to be used in a toner composition according to the present invention, can be found in e.g. EP-A 601 235.

The toner particles according to the present invention can be used in any imaging method wherein toner particles are image-wise deposited on a final substrate and fixed to said substrate. The toner particles can be magnetic or non-magnetic, can be used in a magnetic mono-component developer, in a non-magnetic mono-component developer or in a multi-component developer comprising non-magnetic toner particles according to the present invention and magnetic carrier particles. The toner particles are useful both in black and white imaging as in full colour imaging, both with superimposed toner layers as with adjacent toner layers. The use of toner particles according to the present invention is very beneficial in the production of black and white images, wherein the grey scale (tonal range) in a black and white electrostatographic image, fixed to a final substrate, is extended by realizing the necessary different shades of grey with the superposition of toner particles comprising different amounts of black pigment and in full colour imaging where the different hues are formed by superposition of Y, M, C and K toners.

When full colour imaging has to be performed the use of toner particles according to the present invention, proved to be most useful and it is preferred to use non-magnetic toner particles. The toner particles according to the present invention can be dyed and/or pigmented and thus be used in forming any of the colour layers (Yellow, Magenta, Cyan and Black (Y,M,C,K)). The toner particles according to the present invention are most beneficially used in a finish layer overlaying the toner layers forming the image (both in full colour imaging as in black and white imaging). Since the gloss control is most difficult when various toner layers are overlaid on top of each other, it very preferred to overlay the toner image with a matte or semi-matte finish. Such a matte or semi-matte finish can very well be overlaid on a toner image by depositing a layer of (clear) toner particles according to the present invention on top of the image comprising a plurality over superimposed toner layers . The word "clear" means herein not giving, in a wavelength range extending from 400 to 700 nm, a visible diffuse density, said visible diffuse density being defined as less than 15% light reduction integrated over that wavelength range.

The images overlaid with a finish layer or not, are fixed to the substrate either by contact heat fixing or by non-contact heat fixing. Contact fusing (fixing) processes, proceed by pressure and heat, and the gloss can be controlled by adjusting the surface of the pressure providing means (usually a roller), the amount of heat, the amount of pressure, etc. A contact fusing process presents however some drawbacks, the most important being the risk of hot-offset, i.e. toner particles adhering to the pressure roller. Therefore non-contact fusing (fixing) processes are frequently preferred. However these also pose problems as the toner resins are to be designed low viscous in behaviour above the softening point of the toner. This implies that the toners have the tendency to interflow very good and to offer rather smooth surfaces, thus giving a rather high gloss. The single layers are conforming to the paper and offer a less smooth image. The bi-, ter- and quadruple layers are however more glossy. Therefore there is apart from a rather glossy appearance the problem of gloss differences depending on thickness. This means that the use of toner particles according to the present invention, although also interesting in full colour imaging where the colours are produced by juxtaposition of pixels of different colour, is most beneficial in toner imaging methods where a plurality of toner layers is superimposed to form the image and the toner particles are fixed to the substrate by non-contact fusing (fixing) methods. Such non-contact fusing process includes a variety of embodiments, such as: (1) an oven heating process in which heat is applied to the toner image by hot air over a wide portion of the support sheet, (2) a radiant heating process in which heat is supplied by infrared and/or visible light absorbed in the toner, the light source being e.g. an infrared lamp or flash lamp, (3) a process wherein the heat is transferred to the toner layer by heating the side of the substrate opposite to the side carrying the image. This last process can be implemented in a non-contact system as well as by contacting said side opposite to the side carrying the image by heating means, e.g., a heated roller. In this invention the non-contact fusing systems described above under (1) and (2) are preferred.

In order to control the gloss in an image made by a toner composition according to the present invention and fixed in a non-contact fusing process, it may be beneficial to add post-treatment of the fixed image (i.e. the fused toner particles), with a pressure roller in order to further uniformize the image. The pressure roller exerts preferably a pressure on the fixed image of between 100 N/m and 500 N/m, and the post-treatment proceeds for a time preferably between 30 and 150 msec. There are, according to the present invention, two modes of operating said post-treatment. Said two modes differ in the temperature of said post-treatment. In a first mode the almost cold, having been allowed to cool after leaving the non-contact fusing station, fused image is passed through a pressure roller said pressure rolls having a temperature between 10° C. below and 10° C. above the softening temperature of the toner resin, which means in most cases a temperature of around 120° C. In a second mode of operation, the fused image is directly, without allowing it to cool, passed from the fusing station through a pressure roller, where essentially no additional heat is added to the fixed image, but where the temperature of the post-treatment rollers is kept between 5° C. below and 15° C. above the Tg of the toner resin. Optionally, when necessary for good abhesivity between the fused image and the post-treatment rollers, it is possible to bring abhesive compounds, e.g. silicon oil, fluid waxes, etc, on the surface of the post-treatment rollers.

The toner particles according to the present invention can be prepared by any of the toner preparing means known in the art. Toner particles, according to the present invention are preferably prepared by melt-blending toner resin(s), toner ingredients as desired (e.g. pigment, dyes, charge controller, etc) and the polymeric beads in a melt kneader for 30 minutes at an appropriate temperature, depending on the toner resin(s) that is (are) used. After cooling the solidified mass is pulverized and milled using an ALPINE Fliessbettgegenstrahlmühle type 100AFG (tradename) and further classified using an ALPINE multiplex zig-zag classifier type 100MZR (tradename). The pulverizing and milling an classifying can also proceed by using other commercial apparatus. The classifying, e.g., can proceed by a classifier using the "Coanda"-effect as described in e.g. EP-A 608 902. The average particle size of the separated toner was measured by Coulter Counter model MULTISIZER (tradename).

EXAMPLES

Preparation of the polymeric beads.

Preparation Example 1 (PE1)

The reaction was carried out in a 20 liter double-walled glass cylinder, equipped with a reflux cooler, a stirrer, a thermometer and an inlet, below liquid level, for N2. In this reaction vessel were successively placed, at room temperature:

391 g of distilled water 381 g of ethanol 4 g of ARKOPAL NO60 (trade name for (iso)$H_{19}C_9$—Phenyl—$O(CH_2CH_2O)_6$—H available from Hoechst AG, Frankfurt, Germany)

195 g of methyl methacrylate 5 g of methacryloxypropyl-trimethoxysilane and 1 g of polyvinylpyrrolidon (PVP K30).

The reaction was continuously rinsed with $N_2$ and kept free from air. The above mixture was stirred at 60 rpm, while the temperature was raised to 66° C. Once this temperature was reached, 21 g of a 5% aqueous solution of sodiumpersulfate was added. The reaction mixture was thermostatized at 66° C. About 1 minute after the addition of the initiator solution, the reaction mixture became turbid. After 18 hours of polymerisation, the reaction vessel was cooled at room temperature. The dispersion of polymer bead of a crosslinked copolymer of methyl methacrylate and methacryloxypropyl-trimethoxysilane was filtered through a nylon cloth. The dispersion contained 20 g of polymeric beads pro 100 g of the dispersion.

Separation of the polymer beads from the dispersion

The polymer beads could easily be separated from the liquid by filtering under reduced pressure over a fine paper filter. After washing three consecutive times with water, the filtrate was dried at 50° C. under reduced pressure (about 133 Pa) until a constant weight was reached. The dried filtrate was easily separated into a free flowing powder of separated beads. The particle size distribution of the polymer beads was measured with a COULTER COUNTER (registered trade mark) MULTISIZER particle size analyzer operating according to the principles of electrolyte displacement in narrow aperture and marketed by Coulter Electronics Corp. Northwell Drive, Luton, Bedfordshire, LC 33, UK. In said apparatus particles suspended in an electrolyte (e.g. aqueous sodium chloride) are forced through a small aperture, across which an electric current path has been established. The particles passing one-by-one each displace electrolyte in the aperture producing a pulse equal to the displaced volume of electrolyte. This particle volume response is the basis for said measurement. The polymer beads (PB1) had a volume average diameter ($d_{vp}$) of 3.23 $\mu$m, and had a melting point $TSM_p$, measured as described herein before, greater than 200° C.

Preparation Example 2 (PE2)

Preparation 1 was repeated, except for the proportions of the reagents and the replacement of ethanol by methanol as a cosolvent.

In preparation example 2 , 286 g of distilled water, 477 g of methanol, 4 g of Arkopal N060 (trade name for (iso) $H_{19}C_9$—Phenyl—$O(CH_2CH_2O)_6$—H available from Hoechst AG, Frankfurt, Germany), 195 g of methyl methacrylate, 5 g of methacryloxypropyl-trimethoxysilane, 1 g of polyvinylpyrrolidon (PVP K30) and 10 g of 5% aqueous solution of sodiumpersulphate were used. The polymer beads PB2 had a volume average diameter ($d_{vp}$) of 2.01 $\mu$mn and a melting temperature $TSM_p$, measured has described herein before, greater than 200° C.

Toner Preparation

COMPARATIVE TONER 1 (CT1)

100 parts of polyester P1 of Table 1, with melting temperature $TSM_t$ of 100° C. were melt-blended for 30 minutes at 110° C. in a laboratory kneader. After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) and was found to be 8.0 $\mu$m by volume.

In this toner no polymer beads were present.

TONER 1 (T1)

91 parts by weight of polyester P1 of Table 1, with $TSM_t$ of 100° C., were melt-blended for 30 minutes at 110° C. in a laboratory kneader with 9 parts by weight of polymer beads PB1 ($d_{vp}$=3.23 $\mu$m).

After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) and was found to be 8.2 $\mu$m by volume. In this toner $d_{vp}/d_{vt}$=0.40.

TONER 2 (T2)

85 parts by weight of polyester P1 of Table 1, with $TSM_t$ of 100° C. , were melt-blended for 30 minutes at 110° C. in a laboratory kneader with 15 parts by weight of polymer beads PB2 ($d_{vp}$=2.01 $\mu$m).

After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) and was found to be 8.3 $\mu$m by volume. In this toner $d_{vp}/d_{vt}$=0.24.

COMPARATIVE TONER 2 (CT2)

97 parts of polyester P1 of Table 1, with melting temperature $TSM_t$ of 100° C. were melt-blended for 30 minutes at 110° C. in a laboratory kneader with 3 parts of HELIOGEN BLAU D7072DD (Colour Index PB15:3, trade name of BASF AG, Germany). After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) and was found to be 8.0 $\mu$m by volume.

In this toner no polymer beads were present.

TONER 3 (T3)

88 parts of polyester P1 of Table 1, with melting temperature $TSM_t$ of 100° C. were melt-blended for 30 minutes at 110° C. in a laboratory kneader with 3 parts of HELIOGEN BLAU D7072DD (Colour Index PB15:3, trade name of BASF AG, Germany) and 9 parts by weight of polymer beads PB1 ($d_{vp}$=3.23 $\mu$m). After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) and was found to be 8.0 $\mu$m by volume. In this toner $d_{vp}/d_{vt}$=0.40.

Developer Composition

With each of the toner compositions CT1, CT2, T1, T2 and T3 a multi-component developer was prepared by mixing each toner with 0.5% by weight fumed hydrophobic silica (AEROSIL R972, trade name of Degussa, Germany) and coated ferrite carrier with a volume average particle size of 50 $\mu$m, at a concentration of 5% toner weight with resect to the carrier and activated for 30 minutes in order to attain a stable charge level.

PRINTING EXAMPLES

The Printing and Evaluation of Gloss

Images containing patches of even density were made, in a commercial photocopying machine (AGFA XC 305, trade name of Agfa Gevaert NV, Mortsel, Belgium) on smooth copy paper at a deposition rate corresponding to a single and double layer. In each layer 0.6 mg of toner particles /$cm^2$ were deposited. The images were fused by passing them through a contactless fusing station at 12.5 cm/sec over a length of 40 cm, applying heat to the substrate, such that the surface of the outcoming fused image had a temperature of 140° C.

The gloss difference between the single and double layers was evaluated visually on a scale from 1 to 5:

5=very large difference

4=large difference

3=acceptable visible difference

2=barely visible difference

1=no difference

Printing Example 1

On one sheet of paper a single layer of comparative toner CT1 was applied and on top of half of said layer a second layer of comparative toner CT1 was applied. The gloss differences between a single and a double layer are reported in table 2.

Printing Example 2

On one sheet of paper a single layer of a toner T1 was applied and on top of half of said layer a second layer of a developer comprising toner T1 was applied. The gloss differences between a single and a double layer are reported in table 2.

Printing Example 3

On one sheet of paper a single layer of toner T2 was applied and on top of half of said layer a second layer of toner T2 was applied. The gloss differences between a single and a double layer are reported in table 2.

Printing Example 4

On one sheet of paper a single layer of comparative toner CT2 was applied and on top of half of said layer a second layer of comparative toner CT2 was applied. The gloss differences between a single and a double layer are reported in table 2.

Printing Example 5

On one sheet of paper a single layer of a toner T3 was applied and on top of half of said layer a second layer of a developer comprising toner T3 was applied. The gloss differences between a single and a double layer are reported in table 2.

TABLE 2

| Printing Example | Gloss difference |
|---|---|
| 1 | 4 |
| 2 | 2 |
| 3 | 3 |
| 4 | 4 |
| 5 | 2 |

Printing Example 6

A full colour image was printed in an AGFA CHROMAPRESS (trade name of Agfa Gevaert NV, Mortsel, Belgium), with commercially available 4 colour CHROMAPRESS toners (Yellow, Magenta, Cyan and Black) having in the image four layers of toner particles, forming the yellow, magenta, cyan and black selections of the image). In the image also a patch comprising only Yellow toner, adjacent to a patch comprising four toner layers (Y,M,C,K) in maximum overlay was printed and fused at 140° C.

In printing example 6a NO finish layer was present on the image.

In printing example 6b a finish layer comprising 0.6 $mg/cm^2$ of toner T1 was applied on said image.

In printing example 6c a finish layer comprising 0.6 $mg/cm^2$ of toner T2 was applied on said image.

The differences in gloss between the patch comprising a single toner layer and the patch comprising four superimposed toner layers was again judged visually and evaluated according to the scale given above. The results are reported in table 3.

TABLE 3

| Example | Toner in toplayer | Gloss difference |
|---|---|---|
| 6a | no toplayer | 5 |
| 6b | T1 | 2 |
| 6c | T2 | 3 |

We claim:

1. Toner particles, having an average volume diameter $d_{vt}$ and comprising a binder resin with melting point $TSM_t$, and comprising polymeric beads incorporated in the bulk of said toner particles, wherein said polymeric beads have a melting point $TSM_p$ in °C., such that $TSM_p \geqq TSM_t + 10°$ C. and an average volume diameter $d_{vp}$ such that $0.20 \leqq d_{vp}/d_{vt} \leqq 0.75$.

2. Toner particles according to claim 1, wherein $0.3 \leqq d_{vp}/d_{vt} \leqq 0.6$.

3. Toner particles according to claim 1, wherein said polymeric beads are incorporated in an amount between 5% by weight and 50% by weight with respect to the weight of said binder resin.

4. Toner particles according to claim 1, wherein said polymeric beads are incorporated in an amount between 10% by weight and 30% by weight with respect to the weight of said binder resin.

5. Toner particles according to claim 1, wherein said polymeric beads are cross-linked.

6. Toner particles according to claim 5, wherein said polymeric beads comprise silicon atoms.

7. Toner particles-according to claim 5, wherein said polymeric beads are prepared by a method comprising the steps of:

A) dissolving in an aqueous reaction medium:

1) a silane monomer corresponding to the following general formula:

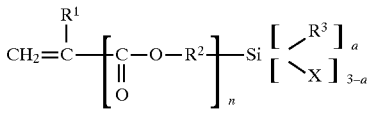

wherein $R^1$=H or $CH_3$ $R^2$=a linear or branched $C_2$–$C_{12}$-alkylene group, the chain of which may be interrupted by at least one member selected from the group consisting of —O—, —NH—, —COO— or —NH—COO— groups $R^3$=a linear or branched $C_1$–$C_6$ alkyl group or a phenyl group X=a hydrolyzable group a=0, 1 or 2 n=0 or 1

2) at least one α,β-ethylenically unsaturated monomer, different from said silane monomer(s), capable of forming a polymer that is soluble in the α,β-ethylenically unsaturated monomer(s) present in said aqueous reaction medium but which is insoluble in water 3) a free radical-forming polymerization initiator that is soluble in the aqueous reaction medium, and 4) a graft-polymerizable polymer containing hydrophilic groups, and capable of forming a graft polymer that remains soluble in said aqueous reaction medium, wherein the amount of said silane monomer present in said aqueous reaction medium is higher than 1% and lower than 25% in weight with respect to the total monomer content and the weight ratio of said graft-polymerizable polymer to said monomer(s) is in the range from 0.2:100 to 8:100 and the weight ratio of polymerization initiator to monomer(s) from 0.1:100 to 6:100, and B) heating the solution to a temperature from 50° C. to the reflux temperature thereof with continuous stirring.

8. Toner particles according to claim 1, wherein said binder resin is a mixture of two polyesters, wherein said polyesters have a different polar character.

9. Toner particles according to claim 5, wherein said binder resin is a mixture of two polyesters, wherein said polyesters have a different polar character.

10. A toner imaging method comprising the steps of:

i) image wise depositing different types of toner particles on a substrate to form an image, ii) depositing a layer of toner particles, having an average volume diameter $d_{vt}$ and comprising a binder resin with melting point $TSM_t$, and polymeric beads incorporated in the bulk of said toner particles, wherein said polymeric beads have i) a melting point $TSM_p$ in °C., such that $TSM_p \geqq TSM_t + 10°$ C. and ii) an average volume diameter $d_{vp}$ such that $0.20 \leqq d_{vp}/d_{vt} \leqq 0.75$, on top of said image and iii) fixing said image.

11. A toner imaging method according to claim 10, wherein said toner particles, having an average volume diameter $d_{vt}$ and comprising a binder resin with melting point $TSM_t$, and polymeric beads incorporated in the bulk of said toner particles, wherein said polymeric beads have a melting point $TSM_p$ in °C., such that $TSM_p \geqq TSM_t + 10°$ C. and an average volume diameter $d_{vp}$ such that $0.20 \leqq d_{vp}/d_{vt} \leqq 0.75$, are clear toner particles.

12. Toner particles, having an average volume diameter $d_{vt}$ and comprising a binder resin with melting point $TSM_t$, and comprising polymeric beads incorporated in the bulk of said toner particles, wherein said polymeric beads have a melting point $TSM_p$ in °C., such that $TSM_p \geqq TSM_t + 10°$ C., an average volume diameter $d_{vp}$ such that $0.20 \leqq d_{vp}/d_{vt} \leqq 0.7$, comprise a least one polymerized α,β-ethylenically unsaturated monomer, and are cross-linked by incorporation of between 1 and 25% by weight of a silane monomer corresponding to the following formula:

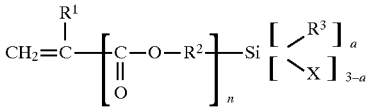

wherein $R^1$=H or $CH_3$ $R^2$=linear or branched $C_2$–$C_{12}$-alkylene group, the chain of which may be interrupted by at least one member selected from the group consisting of —O—, —NH—, —COO— or —NH—COO— groups $R^3$=a linear or branched $C_1$–$C_6$ alkyl group or a phenyl group X=a hydrolyzable group a=0, 1 or 2 n=0 or 1.

13. Toner particles according to claim 12, wherein said silane monomer is

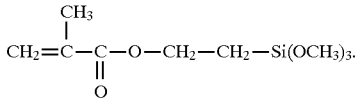

14. Toner particles according to claim 12, wherein said polymeric beads comprise an α,β-ethylenically unsaturated monomer selected from the group of methylacrylate, methylmethacrylate, stearylacrylate and stearylmethacrylate.

15. A toner imaging method comprising the steps of:

i) image wise depositing different types of toner particles on a substrate to form an image, ii) depositing a layer of toner particles, having an average volume diameter $d_{vt}$ and comprising a binder resin with melting point $TSM_t$, and polymeric beads incorporated in the bulk of said toner particles, wherein said polymeric beads have i) a melting point $TSM_p$ in °C., such that $TSM_p \geqq TSM_t + 10°$ C.

and ii) an average volume diameter $d_{vp}$ such that $0.20 \leqq d_{vp}/d_{vt} \leqq 0.75$, on top of said image and iii) comprise a least one α,β-ethylenically unsaturated monomer, and are cross-linked by incorporation of a silane monomer corresponding to the following general formula:

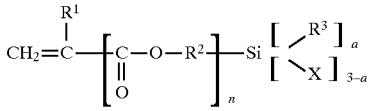

wherein $R^1$=H or $CH_3$ $R^2$=a linear or branched $C_2$–$C_{12}$-alkylene group, the chain of which may be interrupted by at least one member selected from the group consisting of —O—, —NH—, —COO— or NH—COO— groups $R^3$=a linear or branched $C_1$–$C_6$ alkyl group or a phenyl group X=a hydrolyzable group a=0, 1 or 2 n=0 or 1, and iv) fixing said image.

* * * * *